US005649397A

United States Patent [19]

Sauder

[11] Patent Number: 5,649,397

[45] Date of Patent: Jul. 22, 1997

[54] TRIM SUPPORT MEMBER AND WRAP FOR A GARAGE

[76] Inventor: Mark L. Sauder, 14926 North County Line Rd., Spencerville, Ind. 46788

[21] Appl. No.: 542,728

[22] Filed: Oct. 13, 1995

Related U.S. Application Data

[63] Continuation-in-part of Ser. No. 325,990, Oct. 19, 1994, abandoned.

[51] Int. Cl.[6] ..... E06B 1/04

[52] U.S. Cl. ..... 52/211; 52/204.1

[58] Field of Search ..... 52/204.53, 204.1, 52/211, 717.01; 160/201; 49/197, 199, 200

[56] References Cited

U.S. PATENT DOCUMENTS

| | | | |
|---|---|---|---|
| 2,905,980 | 9/1959 | Mitchell | 20/16 |
| 3,226,144 | 12/1965 | Lomaz | 292/113 |
| 3,958,367 | 5/1976 | Fairman | 49/197 |
| 3,980,123 | 9/1976 | Vago | 160/201 |
| 5,036,899 | 8/1991 | Mullet | 160/189 |

OTHER PUBLICATIONS

"Usage Guidelines Trex Wood–Polymer Composite", Mobil Chemical Company, Composite Products Division, Norwalk, Conn.

"Trex New Wood–Polymer Composite from Mobil for Virtually Maintenance–Free Decking and Landscaping", Mobil Chemical Company, Composite Products Division, Norwalk, Conn.

"Trex Wood–Polymer Composite Physical & Mechanical Properties", Mobil Chemical Company, Composite Products Division, Norwalk, Conn.

*Primary Examiner*—Wynn E. Wood
*Assistant Examiner*—Beth Aubrey
*Attorney, Agent, or Firm*—Baker & Daniels

[57] ABSTRACT

An apparatus and method of reducing labor and finishing costs in construction of a garage. A colored, pre-finished, elongate trim support member is attached to the garage frame by pre-finished screws fitting into and through pre-drilled holes in the trim support. A rear elongate recess or channel of the trim support interfits with the edge of adjoining drywall boards thereby hiding any irregularities of the drywall edge. Alternatively, a colored, pre-finished, thermoplastic elongate trim support wrap conceals a construction grade flatway member. The trim support wrap includes a drywall channel into which an irregular drywall edge may be inserted and concealed.

15 Claims, 5 Drawing Sheets

TRIM SUPPORT MEMBER AND WRAP FOR A GARAGE

CROSS-REFERENCE TO RELATED APPLICATIONS

This application is a continuation-in-part of application Ser. No. 08/325,990, filed Oct. 19, 1994, now abandoned.

BACKGROUND OF THE INVENTION

The present invention relates generally to the construction of a garage and, more particularly, to an apparatus and method of mounting an overhead garage door and associated hardware to the garage structure.

During garage construction, after the foundation is built, a framing crew constructs the rough frame of the garage utilizing construction grade 2×4's or other sized boards. At this time, the garage door hardware consisting of the door track and associated mounting brackets are attached to the construction grade 2×4's about the garage door opening. The garage door will then be attached to the door track.

The frame carpenters frame the opening in the garage wall to size using triple studs for sides and a suitable bearing header for the top. They then attach a rim of construction grade 2×4×s flatways to the inside of this opening. Construction grade 2×4×s are rough faced with knots and other imperfections. The frame carpenters attach these 2×4×s with a spike run or hammer and nails leaving hammer tracks and nail holes on the wood.

After the initial framing has been completed, the garage is closed in, mechanicals and insulation are installed, and drywall installers will arrive to finish the garage walls over the construction framing. The installers will normally use a large amount of tape to finish and fill the spaces between the rough edges of the drywall and the frame members constructed for the garage door.

An additional problem with the construction practice discussed above is that painters, arriving later during the construction sequence, have to contend with painting the construction grade wood having rough surfaces and blemishes, created by the previous construction steps. These surfaces require a great amount of preparation, filling and two or more coats of paint, while still not achieving a smooth and aesthetic finish.

In each case, both the drywaller and painter have to contend with working around the garage door and associated hardware, needing to open and close the garage door frequently to pet sufficient access to all locations of the garage wall and trim.

This access problem increases labor costs and the time required to adequately finish and paint the garage. The use of construction grade wood as a framing and finish material and the normal timing sequence of particular garage construction crews do not efficiently and effectively create a smooth trim area about the garage door track hardware.

The present invention is directed to overcoming the aforementioned problems associated with the construction of garages wherein it is desired to reduce labor costs and increase the aesthetic appeal of the garage by replacing the construction grade members with pre-finished, colored trim supports or by providing a pre-finished wrap to conceal the construction grade flatways.

SUMMARY OF THE INVENTION

The present invention overcomes the disadvantages of the above-described prior art garages and method of construction by providing either an elongate, pre-finished, trim support member between the garage frame and the garage door hardware or by concealing the construction grade flatway members with a pre-finished thermoplastic (e.g., polyvinyl chloride or "PVC") wrap.

In one alternative, the invention provides a colored, pre-finished, elongate trim support member attached to the stud frame opening of a garage. The trim support includes a plurality of pre-drilled and countersunk holes into which pre-finished fasteners may attach to connect the trim support to the garage frame. The colored, pre-finished elongate member eliminates the need for painting while the countersunk, pre-drilled holes eliminate the likelihood of framers creating hammer tracks or other blemishes on the finish during construction.

The invention additionally provides an elongate shoulder or channel into which interfits a rough edge of the drywall that forms the finished interior wall.

In a second alternative, the invention provides a colored, pre-finished, extruded, thermoplastic trim support wrap to conceal construction grade flatways. The trim support wrap conceals any knots or imperfections of the rough faced construction grade flatways as well as any hammer tracks or blemishes created during installation of the flatways. Following the installation of the construction grade flatway members, the trim support wrap is attached by securing a nailing flange of the trim support wrap to a garage frame member.

An advantage of the trim support member and trim support wrap of the present invention is that their pre-finished surfaces and the pre-drilled, countersunk holes of the trim support member, eliminate additional finishing steps during garage construction. Use of the trim support member or wrap eliminates the need for the drywaller and painter to paint or finish out around the garage door track hardware.

Another advantage of the trim support member and wrap of the present invention is that the coloring of the trim support member and wrap during manufacturing eliminates the painter labor otherwise incurred prepping and painting the support or flatway after assembly of the garage door hardware.

Yet another advantage of the trim support member and wrap of the present invention is that the milled shoulder and preformed channel hides an unfinished edge of the drywall board abutted against the trim support or flatway member thereby reducing drywall installation labor such as taping and mudding. A reduction of tape and drywall mud is also realized since an entire rough edge of the garage wall is instantly finished and ready for painting. By hiding a jagged edge of the drywall board behind the trim support or a covering flange of the trim support wrap, a clean corner is created.

A further advantage of the trim support member of the present invention is that a large number of construction materials may be utilized to form the trim support ranging from composite materials such as composite wood, plastic, oriented strand board, to masonite, particle board or melamine. All embodiments of the present invention create a smooth exterior grade finished trim and support for the garage door hardware thereby drastically reducing labor costs associated with garage construction and finishing.

The invention, in one form thereof, provides a garage having a wood frame defining an opening for ingress and egress, and a plurality of pre-finished elongate trim support members attached by pre-finished fasteners to the frame about the opening. Door track hardware for an overhead door is attached to the pre-finished elongate trim support member whereby the pre-finished aspect of the member eliminates finishing labor after the door track hardware is attached resulting in a better and more professional look and finish.

The invention, in accordance with another aspect thereof, provides a garage having a wood frame defining an opening for ingress and egress and a plurality of pre-finished, pre-colored composite elongate trim support members attached by a group of fasteners to the frame. The member has a plurality of pre-drilled and countersunk holes through which pre-finished fasteners fasten. Door track hardware for an overhead door is attached by the garage door installer to the pre-finished elongate member. The plurality of pre-drilled holes and pre-finished fasteners in the trim support member reduces finishing labor after the door track hardware is attached.

The invention, in accordance with another form thereof, provides a construction method for a garage comprising the steps of providing a garage having a stud framed garage opening, providing a pre-finished elongate trim board member having a plurality of pre-drilled holes and attaching the board member to the stud frame by pre-finished fasteners through the pre-drilled and countersunk holes whereby the pre-drilled holes reduce the chance of hammer tracks or blemishing of the trim board member. The garage door track and hardware is then attached to the board member by another set of fasteners.

The invention, in accordance with yet another form thereof, provides a garage having a wood frame defining an opening for ingress and egress and a plurality of pre-finished, pre-colored thermoplastic trim support wraps. The trim support wraps conceal construction grade flatways. Door track hardware for an overhead door is attached by means of fasteners which extend through the trim support wraps to the construction grade flatway members. The pre-finished aspect of the trim support wraps eliminate finishing labor after the door track hardware is attached, resulting in a better and more professional look and finish.

The invention, in accordance with still another aspect thereof, provides a construction method for a garage comprising the steps of providing a garage having a stud framed garage opening with construction grade flatways surrounding the framed opening. Providing a pre-finished elongate trim support wrap adapted to conceal the construction grade flatways and attaching the wraps to the garage frame whereby the wraps provide a finished surface to the concealed construction grade flatways. The garage door track and hardware is then attached to the flatway members by a set of fasteners extending through the trim support wraps.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplification set out herein illustrates two preferred embodiments of the invention and such exemplification is not to be construed as limiting the scope of the invention in any manner.

DETAILED DESCRIPTION OF THE INVENTION

Figure 3:
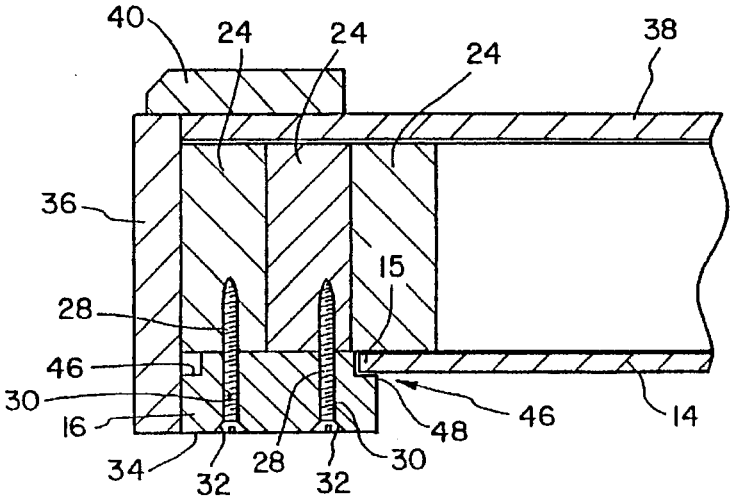
FIG. 3 is a sectional view of a pre-finished trim support member taken along line 3—3 of FIG. 2 and viewed in the direction of the arrows.
Figure 4:
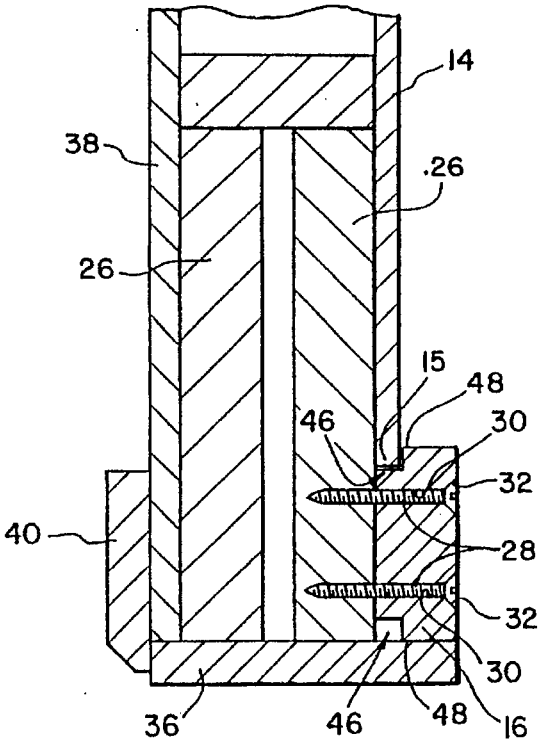
FIG. 4 is a sectional view of a pre-finished trim support member taken along line 4—4 of FIG. 2 and viewed in the direction of the arrows.

In an exemplary embodiment of the invention as shown in the drawings and particularly by referring to FIGS. 1–5, a garage 10 is shown having a foundation 12. Wallboards such as drywall sheets 14 attach to stud frame members 24, 26 to form the walls of garage 10 as shown in FIGS. 3 and 4. Drywall sheets 14 abut and interfit with the elongate trim support members 16 of the present invention that border the garage door opening. Overhead door track hardware, such as brackets 18, attach door track 20 along with an associated overhead sliding door 22 to trim support members 16.

Figure 1:
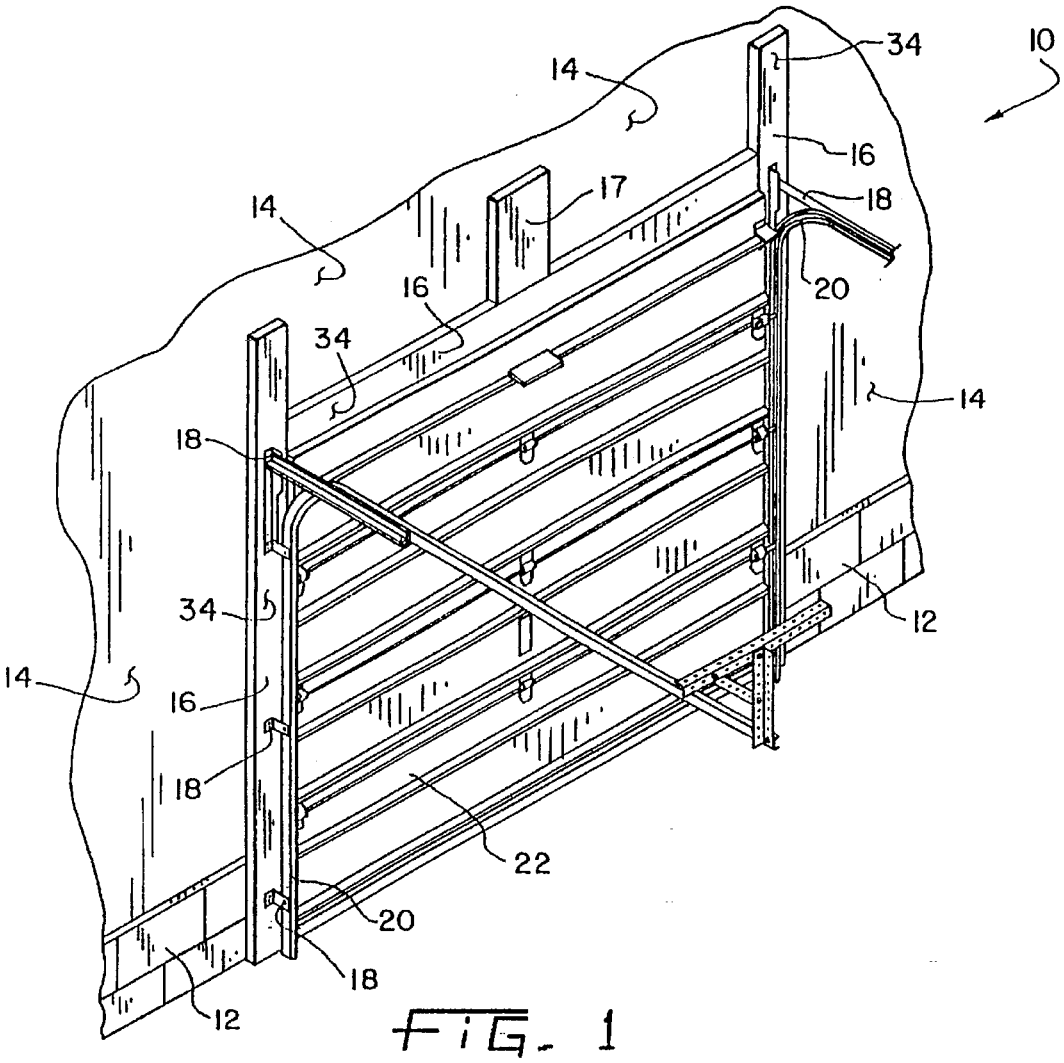
FIG. 1 is a perspective interior view of a garage of the type to which the present invention pertains.
Figure 2:
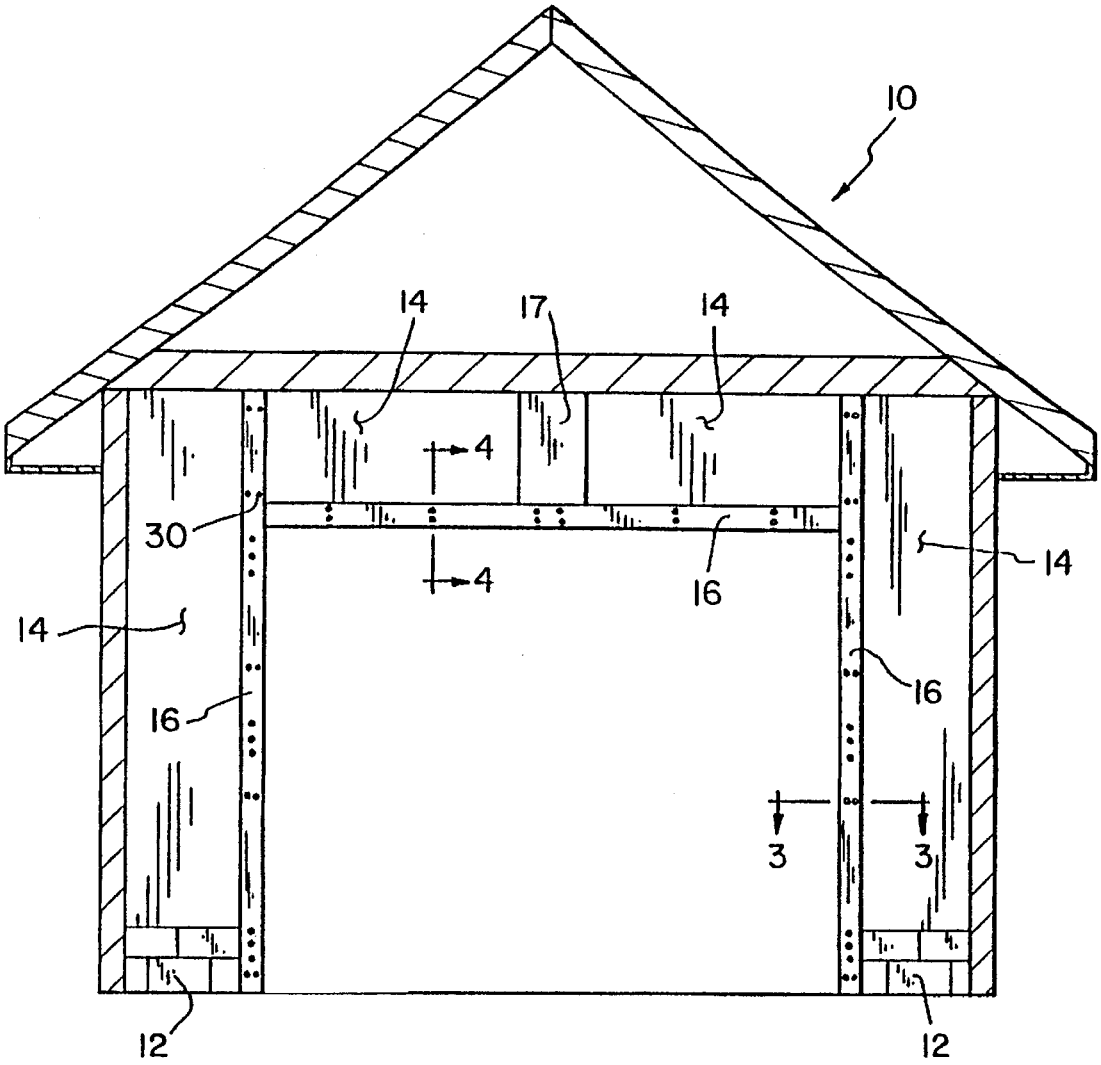
FIG. 2 is an elevational view of the framing of the garage.

As shown in FIG. 2, elongate trim support members 16 frame the sides and head of the door opening for garage 10. Although there is only one door opening shown, it is understood that the present invention may be utilized with garages having more than one door opening of ingress and egress. FIG. 1 shows a 2×10 header block 17 located adjacent an elongate trim support member 16 for attachment of an overhead door spring and door opener. Header block 17 is constructed and utilized in a similar manner as elongate trim member 16 as discussed below.

Trim support members 16 comprise smooth surfaced, pre-colored, pre-drilled, smooth exterior grade boards which may be formed from a number of materials. Materials having the requisite strength and finish may comprise particular grades of masonite type products, typical wood composites such as hardboard, non-wood composite plastic materials such as plastic lumber, melamine or some types of particle board, or a product such as Trex wood-polymer composite commercially available from Mobil Chemical Company, Norwalk, Conn. Other materials from which trim support members 16 may be constructed are composite finished wood products or such wood products wrapped in aluminum or plastic. Utilization of any of the above types of material or equivalents will enable construction of a very flat, pre-finished product having a wood quality finish with strength enough to withstand the stresses of opening and closing the overhead door 22.

Trim support members 16 are pre-colored in the sense that they are colored during manufacturing or prior to installation. The elimination of the need to paint trim support members 16 after installation is one of the benefits of the invention.

At the construction site, after the rough framing of garage 10 is complete, utilizing, for instance, 2×4 construction grade boards or studs forming garage supports 24 on opposing sides of the door opening and 2×10 boards forming a bearing header 26 between garage supports 24 and over the door opening, the garage contractor will attach trim support members 16 with the use of fasteners such as screws 28 into either garage supports 24 or bearing header boards 26.

Trim support members 16 have a plurality of pre-drilled holes 30 with recessed or countersunk portions 32 to enable screws 28 to attach beneath the face surface 34 of trim support 16.

As shown in FIG. 3, one side of the garage opening includes garage support 24 having a garage door opening trim 36 facing an opposite similar garage support 24 (not shown). FIG. 4 shows trim element 36 attached to bearing header boards 26 oriented to face downward. The exterior of garage 10 includes an exterior lining 38 with exterior trim 40 attached to the frame members 24 and 26.

Figure 5:
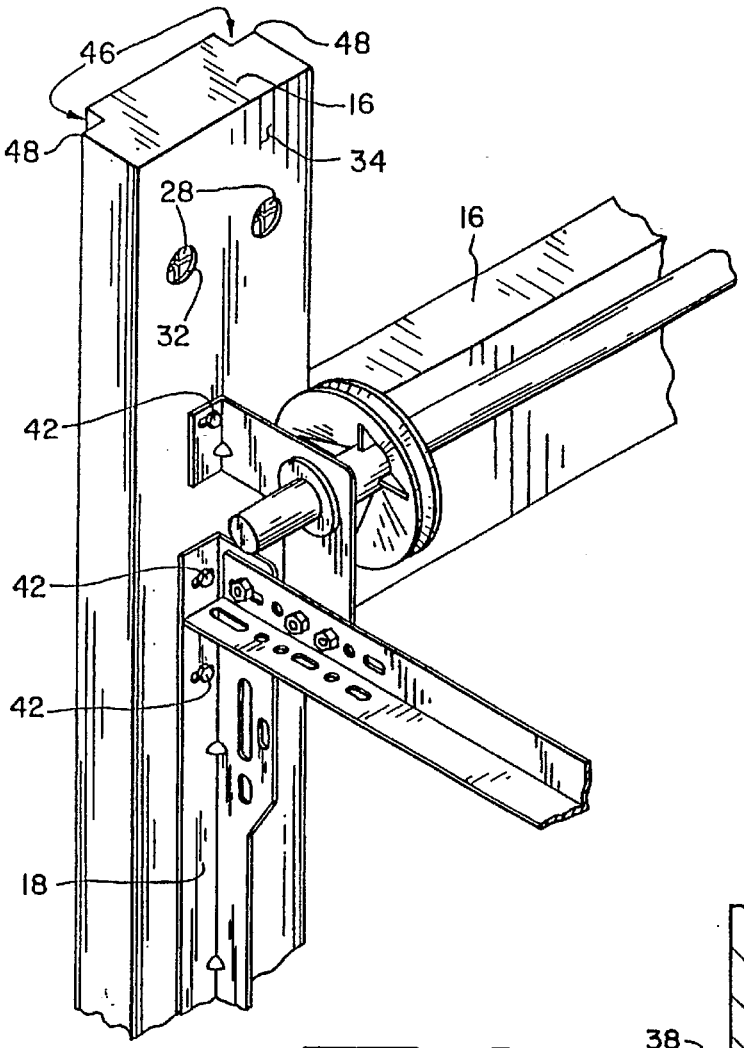
FIG. 5 is an enlarged perspective view of one corner of the garage opening with a pre-finished trim support member of the present invention installed.

Attachment of garage door hardware such as brackets 18 and track 20 to trim support 16 utilizes fasteners such as screws 42 as shown in FIG. 5. Screws 42 attach through brackets 18 into trim support members 16.

As shown most clearly in FIGS. 3 and 4, trim support members 16 include at least one but preferably two rear milled channels or recesses 46 having an edge 48 formed the entire length of the elongate trim support members 16. Drywall sheets 14, having rough edges 15, interfit or engage recess channel 46 so that the straight edge 48 of trim support member 16 hides from view rough edge 15 of drywall sheet 14. By hiding rough edge 15 from view, additional drywall finish preparation and labor may be eliminated prior to painting.

The construction method utilized with new trim support members 16 reduces labor costs and finishing work necessary for garage 10. After the stud framing, such as garage support 24 and 2×10 bearing headers 26 are in place, the construction crew will then attach trim support members 16 by means of pre-finished screws 28 to the frame members. Since each of the pre-finished screws 28 inserts into a pre-drilled hole 30 which additionally includes a recess or counter sunk portion 32, no hammer tracks will be formed and no impact tools are necessary for attachment. This ensures that face surface 34 of trim support members 16 will remain smooth, level and blemish free. Typically, the pre-finished fasteners will match in color trim support member 16 for example a white painted screws 28 would match a pre-colored white trim support member 16.

The construction crew or a separate company will then attach the associated garage door hardware such as brackets 18 and door track 20 by means of an additional set of screws 42 attaching to trim support member 16. Once garage door 22 is attached to track 20, the garage may be closed-in while the rest of the framing and/or exterior are constructed.

Sometime after the framing is complete and garage door 22 is operational, a drywall crew will attach drywall sheets 14 to the frame member such as garage support 24 and bearing header boards 26 to create the interior walls of the garage. Rough edges 15 of drywall sheets 14 will be inserted into recess 46 whereby rough edge 15 will be hidden from view by edge 48 of trim support member 16. This will eliminate the use of tape by the drywall crew to hide rough edge 15, reduce the amount of drywall mud required during wall finishing and, more significantly, reduce the labor required to install and finish the drywall sheeting.

After drywall sheets 14 are finished, then a painting crew will arrive to paint garage 10 and drywall sheets 14. Since trim support member 16 is pre-colored at the factory, no painting is necessary, especially around garage frame door hardware such as brackets 18 and door track 20 saving substantial amounts of time. Additionally, no finishing of trim support member 16, such as by putty or filler, is necessary since smooth surface 34 creates an aesthetically appealing flat surface with a quality looking finish.

Trim support member 16 of the present invention is a convenient product capable and compatible for use with existing, cutting, fastening and drilling methods common to construction sites. The only field work necessary to be done to trim support member 16 would be field cutting the length to the proper application size.

By use of the trim support member 16, substantial savings in labor and finishing work utilized in garage 10 construction are realized.

Figure 6:
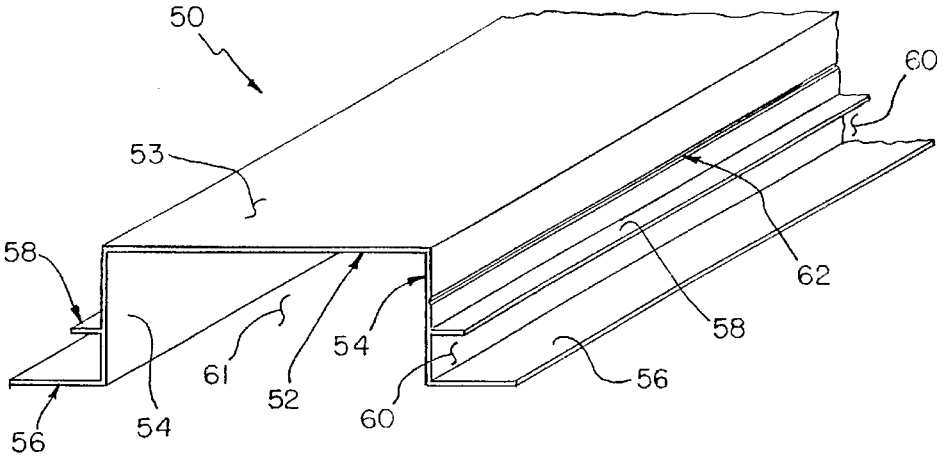
FIG. 6 is a perspective view of a trim support wrap of the present invention adapted to conceal an elongate 2×4 flatway in accordance with a second embodiment of the invention.
Figure 7:
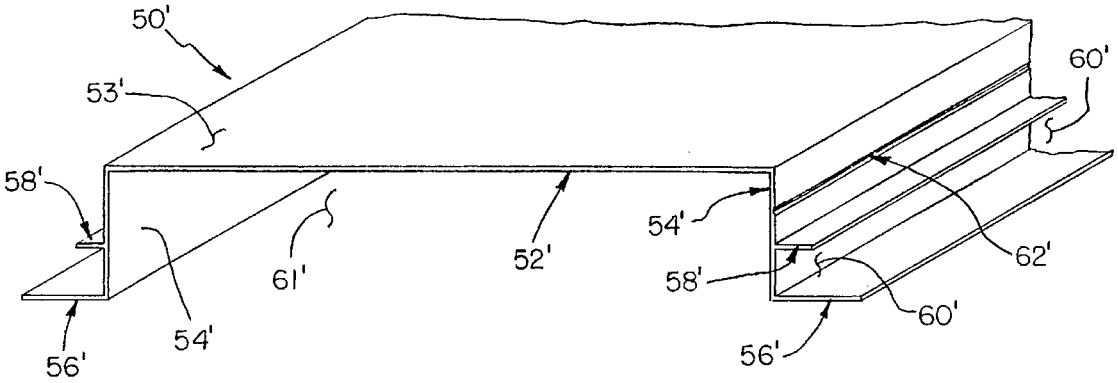
FIG. 7 is a perspective view of a trim support wrap of the present invention adapted to conceal an elongate garage door header block.
Figure 8:
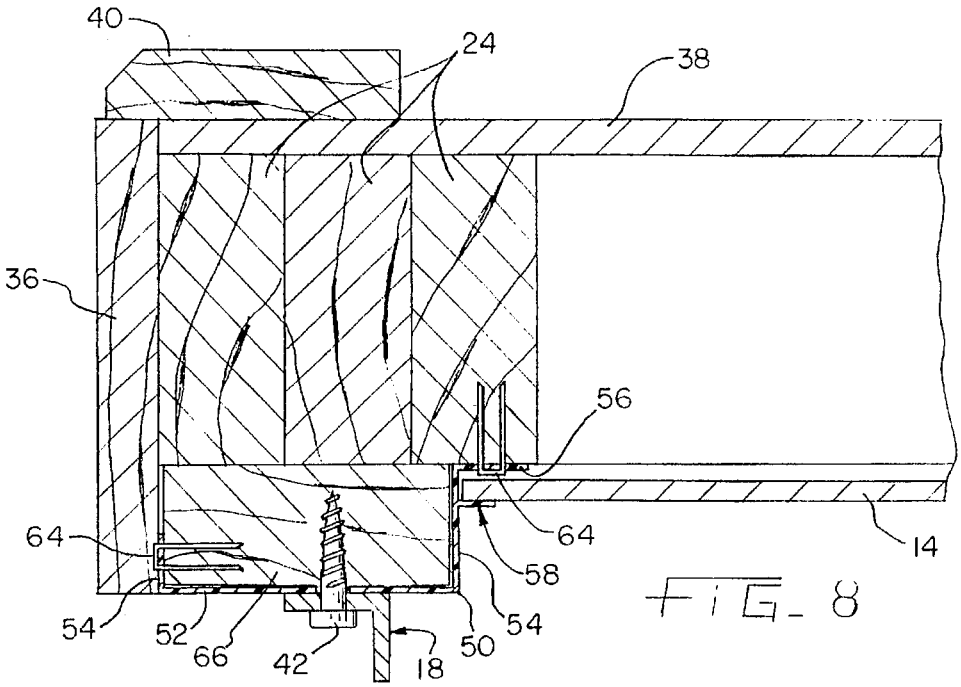
FIG. 8 is a sectional view of the trim support wrap attached to the garage door framing.
Figure 9:
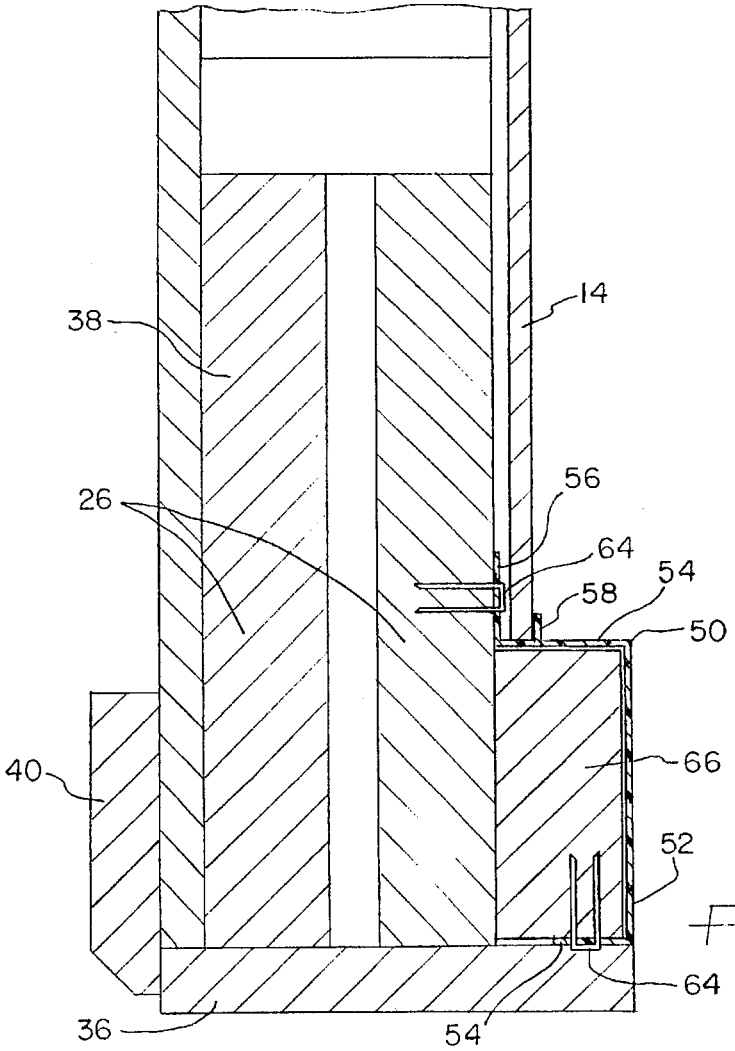
FIG. 9 is a further sectional view of the trim support wrap attached to the garage door framing.

An alternative embodiment of the invention utilizes a trim support wrap 50 shown in FIGS. 6–9. In this embodiment of the invention trim support wraps 50, shown in FIGS. 6 and 7, of the present invention are used to conceal a rough surfaced, construction grade flatway member 66. Construction grade flatways are installed where trim support members 16, and header block 17 are shown in FIG. 1. After installation of the construction grade flatways, trim support wraps 50 are installed to cover the flatways 66 as shown in FIGS. 8 and 9. Garage door hardware 18 is then secured to the flatways 66 through the trim support wraps 50 and finally the interior drywall 14 is installed.

Trim support wraps 50 comprise a colored thermoplastic material extruded into a pre-finished elongate member with a generally C-shaped cross-section with extending flanges. Materials such as regrind PVC are suitable for inexpensively forming the trim support wrap 50. Other materials which enable the manufacture of a colored, elongate member with the required cross-section, are readily cut to length and provide a good quality finish, may also be used. Trim support wraps 50 are typically pre-colored in a white tone during manufacture by appropriate selection or blending of the polymer. The elimination of the need to paint or finish the construction grade flatway member 66 after installation is a primary benefit of the invention.

A trim support wrap 50 is displayed in FIG. 6 and comprises a wrap face 52 which has an exterior finished surface 53 and two wrap sides 54 extending from the wrap face 52 to form a generally C-shaped cross-section. Extending at approximately right angles from each wrap side 54 is a nailing flange 56 located at the end of the wrap side 54 opposite the wrap face 52 and extending in a direction away from the other wrap side 54. A drywall flange 58 extends at an approximately right angle from each wrap side 54 between the nailing flange 56 and the wrap face 52 and in the same direction as the nailing flange 56. A drywall channel 60 is defined on each wrap side 54 by the wrap side 54, nailing flange 56, and drywall flange 58.

The trim support wrap 50 of FIG. 6 is adapted to conceal a construction grade 2×4 with actual dimensions which are approximately 1.5"×3.5" and a ½ drywall sheet. Although the dimensions of the trim support wrap 50 are adapted to cooperate with standardized building materials, the dimensions can be varied to cooperate with alternative combinations of materials or non-standardized materials.

FIG. 7 illustrates a trim support wrap 50' which is similar to the trim support wrap 50 except that the dimensions have been altered to so that trim support wrap 50' is adapted to cooperate with a garage door header block 17 constructed of construction grade 2×8's with actual dimensions which are approximately 1.5"×7.25". The trim support wrap elements shown in FIG. 7 are similar to those shown in FIG. 6 and similar elements are denoted by similar primed numbers (e.g., 52 in FIG. 6 and 52' in FIG. 7 are equivalent in all respects except for their dimensions). As shown in FIG. 7, by adjusting the dimensions of the wrap face 52 and wrap sides 54 the trim support wrap can be used to conceal different sizes of lumber. The size of the flatway member determines the width of the wrap face 52 and wrap sides 54, while the thickness of the drywall, or other wall covering, determines the distance between the nailing flange 56 and drywall flange 58. Thus, any combination of building materials may be readily accommodated by manufacturing trim support wraps 50 with the desired dimensions.

As shown in FIG. 6 (and in FIG. 7 by corresponding primed numbers), a score groove 62 is located on one wrap side 54 between the wrap face 52 and the drywall flange 58 and provides a means by which a drywall channel 60 may be detached prior to installation of the trim support wrap 50. The score groove 62 may be formed during extrusion of the trim support wrap or by cutting a groove into the wrap side. The drywall channel 60 may be removed with a razor knife, hand snips, hand saw, circular saw or other suitable cutting instrument while using the score groove as a cutting guide. Alternatively, the drywall channel 60 may be removed by bending the wrap side 54 at the score groove 62 to break the wrap side 54 at the location of the score groove 62. After one drywall channel 60 is removed the trim support wrap may be cut to length and installed.

If the trim support wrap 50 is to be installed such that drywall sheets 14 will abut both sides of the flatway 66, such as in the area above the horizontal header (FIG. 1), a drywall channel 60 will not be removed. This will allow the trim support wrap 50 to conceal the rough edge 15 of both abutting drywall sheets 14. Header block 17 shown in FIG. 1 illustrates one location in which a trim support wrap having two drywall channels would be advantageous.

It will often be advantageous to remove a drywall channel 60 for only part of the length of a trim support wrap 50 which will be used to conceal a vertical flatway 66. The drywall channel 60 can be selectively removed for only that portion of trim support wrap 50 which will be installed at or below horizontal flatway 66 located above the garage door 22. Thus, two drywall channels 60 will be available to conceal two drywall rough edges 15 above the garage door 22 where vertical flatway 66 is abutted by drywall sheets 14 on two sides.

Another advantage of the trim support wraps is that they may be partially nested within each other for transportation and storage. Trim support wraps 50 may be manufactured with a slight taper to facilitate their stacking. Thus, channel 61 would not be perfectly rectangular but slightly trapezoidal with the side formed by wrap face 52 being slightly smaller than the distance between wrap sides 54 at the point the nailing flanges 56 extend therefrom. Trim support wraps 50 of the same dimensions may also be alternatively turned 180° so that the drywall channel 60 of one trim support wrap 50 is nested within a cavity 61 formed by the wrap face 52 and wrap sides 54 of another trim support wrap 50. It is also possible to place trim support wraps 50 of smaller dimensions entirely within the cavity 61 of a larger trim support wrap 50. By nesting the wraps, the space required to store and ship the trim support wraps is reduced.

At the construction site, after the rough framing of garage 10 is complete, utilizing, for instance, 2×4 construction grade boards or studs forming garage supports 24 on opposing sides of the door opening and 2×10 boards forming a bearing header 26 between garage supports 24 and over the door opening, the garage contractor will attach 2×4 construction grade flatways 66 to the garage supports 24 and bearing header boards 26 with a spike or staple gun or hammer and nails. As shown in FIGS. 8 and 9, flatways 66 are positioned so that, after drywall channel 60 is removed, the outer edge of the wrap sides 54 will be flush with the garage opening defined by the garage supports 24 or bearing header boards 26 to which the trim elements 36 are attached.

The trim support wraps 50 are installed following the installation of the flatways 66. Prior to installation, one of the drywall channels 60 is removed at score groove 62 and the length of trim support wrap 50 is cut to conform to the length of the flatway 66 to be concealed. The trim support wrap 50 may also be installed with both drywall channels intact or with only part of a dry wall channel 60 removed if drywall sheets will abut both sides of the flatway 66 at any point. The manufactured length of the trim support wraps 50 may be varied and is advantageously 10 feet. The trim support wraps 50 can be readily cut to length using hand or power tools generally available and used on-site by the residential construction trades.

The trim support is attached to the garage by driving staples 64 or nails through the nailing flange 56 into a garage support 24 or bearing header board 26 as shown in FIGS. 8 and 9, respectively. Staples 64 or nails can also be driven through the wrap side 54 from which a drywall channel 60 has been removed into the flatway 66 as shown in FIGS. 8 and 9. Labor can be further reduced by using a pneumatic nail or staple gun. Other fasteners such as wood screws or adhesives may also be used to attach the trim support wrap 50 to the garage without marring the exterior finished surface 53 of the trim support wrap 50. Fasteners attached through the nailing flange 56 will be hidden from view once the drywall 14 is inserted into the drywall channel 60 eliminating the need for colored fasteners. Fasteners attached through the wrap side 54 will be hidden from view once trim elements 36 are installed.

After installation of the trim support wrap 50 the associated garage door hardware such as brackets 18 and door track 20 are installed by means of screws 42 extending through the trim support wrap 50 and anchored within the flatway 66. Holes can be easily predrilled or wood screws 42 easily turned through installed trim support wrap 50 to facilitate the installation of brackets 18. Once garage door 22 is attached to track 20, the garage may be closed-in while the rest of the interior and/or exterior are constructed and finished.

The trim element 36 and drywall 14 are typically installed following the installation of the garage door 22 and associated hardware. Trim elements 36 are attached to the garage supports 24 and bearing header boards 26. The installed trim element 36 engages and conceals the wrap side 54 from which a drywall channel 60 has been removed as shown in Pigs. 8 and 9.

The dry wall crew will attach drywall sheets 14 to framing members such as garage support 24 and bearing header boards 26 to create the interior walls of the garage. One edge of the a drywall sheet 14 is inserted into the remaining drywall channel 60 so that the straight edge of the drywall flange 58 hides from view the rough edge 15 of the drywall sheet 14. Hiding rough edge 15 from view with drywall flange 58 eliminates the labor and materials that would otherwise be required to conceal rough edge 15 with drywall tape and mud. A significant savings in reduced labor costs is thereby achieved.

After the drywall sheets 14 have been installed, a painting crew will arrive to paint the garage 10 and drywall sheets 14. Since the trim support wraps 50 are manufactured of colored thermoplastic material, they do not require painting. This eliminates the need to paint around the garage frame door hardware such as the brackets 18 and door track 20, saving substantial amounts of labor. Additionally, no finishing of the construction grade flatway 66, such as by putty or filler, is required because the trim support wrap 50 provides a smooth exterior finished surface 53 and presents an aesthetically appealing flat surface with a quality looking finish.

The trim support wrap 50 of the present invention is a convenient product capable and compatible for use with existing construction methods and materials. By use of the trim support wrap 50, substantial savings in labor and finishing work otherwise required in garage 10 construction are realized.

While this invention has been described as having preferred embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A garage comprising:

a wood frame defining an opening for ingress and egress;

a plurality of smooth surfaced, pre-colored and pre-finished elongate trim support members attached by fasteners to said frame about said opening;

door track hardware for an overhead door, said door track hardware attached to said pre-finished elongate trim support members whereby said pre-finished aspect of said members eliminates finishing labor after the door track hardware is attached; and a wallboard having an edge, said wallboard attached to said wood frame, at least one said elongate member having a generally rectangular cross section and including at least one elongate recess forming an indented shoulder in said generally rectangular cross section at a corner of said cross section and into which said wallboard edge interfits, said recess hiding said interfit wallboard edge from view whereby additional wall finishing steps are reduced.

2. A garage construction comprising:

a wood frame defining an opening for ingress and egress;

a plurality of smooth surfaced, pre-finished, pre-colored composite elongate members attached by a first group of pre-finished fasteners to said frame;

door track hardware for a door, said door track hardware attached by a second group of fasteners to said pre-finished elongate members, said elongate members having a plurality of pre-drilled holes through which said first group of fasteners extend whereby the pre-finished, pre-colored aspect of said members reduces finishing labor after the door track hardware is attached; and a wallboard having an edge, said wallboard attached to said frame, at least one of said plurality of elongate members having a generally rectangular cross section and including at least one elongate recess forming an indented shoulder in said generally rectangular cross section at a corner of said cross section and into which said wallboard edge interfits, said recess hiding said interfit wallboard edge from view whereby additional wall finishing steps are reduced.

3. A construction method for a garage, said method comprising:

constructing a garage frame having a stud framed opening for ingress and egress;

providing a plurality of smooth surfaced, pre-colored and pre-finished elongate board members having a plurality of pre-drilled holes, at least some of the elongate members have a generally rectangular cross section and include at least one elongate recess forming an indented shoulder in said generally rectangular cross section at a corner of said cross section;

attaching said pre-finished elongate board members to said stud frame by fasteners that extend through said pre-drilled holes;

then attaching garage door track hardware to said elongate board members by fasteners; and interfitting edges of wallboard sheets into said recesses whereby the wallboard edges are hidden from view and additional wall finishing steps are reduced.

4. A garage comprising:

a wood frame defining an opening for ingress and egress;

a plurality of elongate wood flatway members attached to said frame about said opening;

a plurality of elongate thermoplastic trim support wraps attached to said garage and concealing said flatway members, said trim support wraps having a substantially planar face with a pre-finished surface and integral first and second sides extending from respective opposite ends of said face in a common direction and at substantially right angles from said face whereby said trim support wraps have a substantially C-shaped cross section; and door track hardware for an overhead door, said door track hardware attached to said concealed flatway members by means of fasteners extending through said trim support wrap faces whereby said pre-finished surface of said trim support wraps reduces finishing labor after the door track hardware is attached.

5. The garage of claim 4 in which said plurality of trim support wraps comprise extruded thermoplastic sections.

6. A garage comprising:

a wood frame defining an opening for ingress and egress;

a plurality of elongate wood flatway members attached to said frame about said opening;

a plurality of elongate thermoplastic trim support wraps attached to said garage and concealing said flatway members, said trim support wraps having a substantially planar face with a pre-finished surface and a first and second side extending from opposite ends of said face in a common direction and at substantially right angles from said face;

a nailing flange attached to an end of said first side opposite said face and extending away from said second side at a substantially right angle to said first side;

a drywall flange attached to said first side at a position between said nailing flange and said face and extending away from said second side at a substantially right angle to said first side; whereby said first side, said nailing flange, and said drywall flange define a drywall channel into which a rough edge of a drywall sheet may be inserted thereby reducing finishing labor; and door track hardware for an overhead door, said door track hardware attached to said concealed flatway members by means of fasteners extending through said trim support wraps whereby said pre-finished surface of said trim support wraps reduces finishing labor after the door track hardware is attached.

7. The garage of claim 6 in which said nailing flange extends further from said first side than said drywall flange.

8. The garage of claim 6 in which each said trim support wrap further comprises:

a second nailing flange attached to an end of said second side opposite said face and extending away from said first side at a substantially right angle to said second side;

a second drywall flange attached to said first side between said nailing flange and said face and extending away from said first side at a substantially right angle to said second side;

whereby said second side, said second nailing flange, and said second drywall flange define a second drywall channel; and a score groove located between said face and said drywall flanges on said second side whereby said second drywall channel may be readily separated from said second side at said score groove.

9. The garage of claim 6 in which said trim support wraps comprise pre-colored thermoplastic extrusions.

10. The garage of claim 6 in which at least one of said trim support wraps is adapted to conceal a 2×4 wooden member.

11. The garage of claim 6 in which at least one of said drywall channels is adapted to conceal an edge of a sheet of ½" drywall.

12. The garage of claim 6 in which said trim support wraps are constructed of polyvinyl chloride.

13. A construction method for a garage, said method comprising:

constructing a garage frame having a stud framed opening for ingress and egress, said frame including a plurality of construction grade flatway members;

installing a plurality of elongate thermoplastic trim support wraps on said flatway members thereby concealing said flatway members, said trim support wraps having a substantially planar face with a pre-finished surface and an integral first and second side extending from opposite ends of said face in a common direction and at substantially right angles from said face whereby said trim support wraps have a substantially C-shaped cross section; and attaching garage door track hardware to said concealed flatway members by means of fasteners extending through said trim support wrap faces.

14. A construction method said method comprising:

constructing a garage frame having a stud framed opening for ingress and egress, said frame including a plurality of construction grade flatway members;

installing a plurality of elongate thermoplastic trim support wraps on said flatway members; said trim support wraps having a substantially planar face with a pre-finished surface and a first and second side extending from opposite ends of said face in a common direction and at substantially right angles from said face; said first side having a nailing flange attached to an end of said first side opposite said face and extending away from said second side at a substantially right angle to said first side; a drywall flange attached to said first side at a position between said nailing flange and said face and extending away from said second side at a substantially right angle to said first side; whereby said first side, said nailing flange, and said drywall flange define a drywall channel into which a rough edge of a drywall sheet may be inserted; said plurality of trim support wraps being installed by attaching fasteners to said garage frame through said nailing flange to thereby conceal said flatway members;

inserting an edge of a drywall sheet into said drywall channel;

attaching said drywall sheet to said garage frame; and attaching garage door track hardware to said concealed flatway members by means of fasteners extending through said trim support wraps.

15. The construction method of claim 14 wherein said trim support wraps further comprise a second nailing flange attached to an end of said second side opposite said face and extending away from said first side at a substantially right angle to said second side; a second drywall flange attached to said first side between said nailing flange and said face and extending away from said first side at a substantially right angle to said second side; whereby said second side, said second nailing flange, and said second drywall flange define a second drywall channel; and a score groove located between said face and said drywall flanges on said second side whereby said second drywall channel may be readily separated from said second side at said score groove; and said construction method further comprises:

removing a part of one of said second dry wall channels before installing said plurality of trim support wraps.

* * * * *